US008820572B2

(12) United States Patent
Miller

(10) Patent No.: US 8,820,572 B2
(45) Date of Patent: Sep. 2, 2014

(54) INSERT TO HOLD A CAN FOR USE WITH AN INVERTED BOTTLE HOLDER

(71) Applicant: Alexander K. Miller, Dallas, TX (US)

(72) Inventor: Alexander K. Miller, Dallas, TX (US)

( * ) Notice: Subject to any disclaimer, the term of this patent is extended or adjusted under 35 U.S.C. 154(b) by 0 days.

(21) Appl. No.: 13/951,227

(22) Filed: Jul. 25, 2013

(65) Prior Publication Data

US 2013/0306664 A1 Nov. 21, 2013

Related U.S. Application Data

(63) Continuation-in-part of application No. 13/847,307, filed on Mar. 19, 2013, which is a continuation-in-part of application No. 13/051,785, filed on Mar. 18, 2011, now Pat. No. 8,413,838.

(51) Int. Cl.
*B65D 25/00* (2006.01)
*A47G 23/02* (2006.01)

(52) U.S. Cl.
CPC ..... *A47G 23/0241* (2013.01); *A47G 23/0225* (2013.01); *A47G 23/0208* (2013.01)
USPC ..... 220/737; 220/703; 206/217; 215/395

(58) Field of Classification Search
CPC ..... A47G 23/0216; A47G 23/0258; A47G 23/02; A47G 23/0208; A47G 23/0225; A47G 23/0241
USPC ..... 220/737, 697, 694, 703, 738, 739, 482, 220/476, 324; 215/390; 248/317, 690, 692, 248/318, 312.1; 206/217
See application file for complete search history.

(56) References Cited

U.S. PATENT DOCUMENTS

| | | | | |
|---|---|---|---|---|
| 4,927,033 | A * | 5/1990 | Patera et al. | 211/41.9 |
| D367,209 | S * | 2/1996 | Flint et al. | D7/620 |
| 5,794,904 | A * | 8/1998 | Hackley | 248/311.3 |
| 7,543,712 | B2 * | 6/2009 | Purushothaman | 211/41.9 |

* cited by examiner

*Primary Examiner* — Robert J Hicks
*Assistant Examiner* — Kareen Rush
(74) *Attorney, Agent, or Firm* — Bell Nunnally & Martin LLP; Craig J. Cox

(57) ABSTRACT

A holder intended to hold a can upside down inside a container when attached thereto is described. The holder includes a clip having an inner wall and an outer wall spaced to accept an exterior wall of the container in between, where the clip is formed at an arc corresponding to the arc of the exterior wall of the container and a deck connected in a permanently fixed relationship to the clip and extending into the container, the deck including an aperture. The holder also includes an insert inserted into the aperture in the holder, the insert formed by a can receptacle having a first ledge to hold the top of the can when inserted therein and a neck insert, the neck inserted into the aperture until a second ledge on the insert comes to rest against the deck of the holder.

17 Claims, 10 Drawing Sheets

INSERT TO HOLD A CAN FOR USE WITH AN INVERTED BOTTLE HOLDER

CROSS REFERENCE TO RELATED INFORMATION

This application is a continuation-in-part of U.S. patent application Ser. No. 13/847,307, filed Mar. 19, 2013, now U.S. Pat. No. 8,413,838; which is a continuation-in-part of U.S. patent application Ser. No. 13/051,785, filed Mar. 18, 2011, now U.S. Pat. No. 8,413,838.

TECHNICAL FIELD

The present disclosure is directed to clips for holding a can inverted in a drinking glass or pitcher using an insert that engages with an inverted bottle holder.

BACKGROUND OF THE INVENTION

While beer and margaritas have always been popular drinks, a recent phenomenon has occurred where frozen margaritas have been combined with beer. The "beer rita" is typically made by inverting a bottle of beer into a glass or pitcher of frozen margaritas. This allows the beer to slowly combine with the margarita as it is being consumed. The popularity of the beer rita has been increasing as it has been shown on various reality televisions shows. While simply inverting a beer bottle into a drink glass is effective, it is not always stable and the beer bottle can fall or be easily knocked out of the glass.

It would be helpful to have an inexpensive device that would hold a beer bottle more securely in a glass or pitcher. Further it would be advantageous if such a device could be used for promotions or advertising for beer or alcohol companies or restaurants or bars.

BRIEF SUMMARY OF THE INVENTION

In accordance with the concepts described herein, an embodiment of a holder intended to hold a can upside down inside a container when attached thereto, the container having an exterior wall having an arc and oriented at an angle with respect to the vertical orientation of the container. The holder includes a clip having an inner wall and an outer wall spaced to accept the exterior wall of the container in between, wherein the clip is formed at an arc corresponding to the arc of the exterior wall of the container and a deck connected in a permanently fixed relationship to the clip and extending into the container, the deck including an aperture. The holder also includes an insert inserted into the aperture in the holder, the insert formed by a can receptacle having a first ledge to hold the top of the can when inserted therein and a neck insert, the neck inserted into the aperture until a second ledge on the insert comes to rest against the deck of the holder.

In another preferred embodiment a method is described for holding a can inverted in an interior of a container, the container having an arc and an exterior wall oriented at an angle with respect to the vertical orientation of the container. The method includes sliding a bottle holder onto the rim of the container, where the bottle holder is formed by a clip having an inner wall and an outer wall spaced to accept the exterior wall of the container in between, wherein the clip is formed at an arc corresponding to the arc of the exterior wall of the container, and a deck connected in a permanently fixed relationship to the clip and extending into the container, the deck including an aperture. Next, an insert is inserted into the aperture in the holder, where the insert is formed by a can receptacle having a first ledge to hold the top of the can when inserted therein and a neck insert, the neck inserted into the aperture until a second ledge on the insert comes to rest against the deck of the holder. A can is then inserted inverted into aperture of the deck such that the bottle holder and insert holds the can inverted in the interior of the container.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
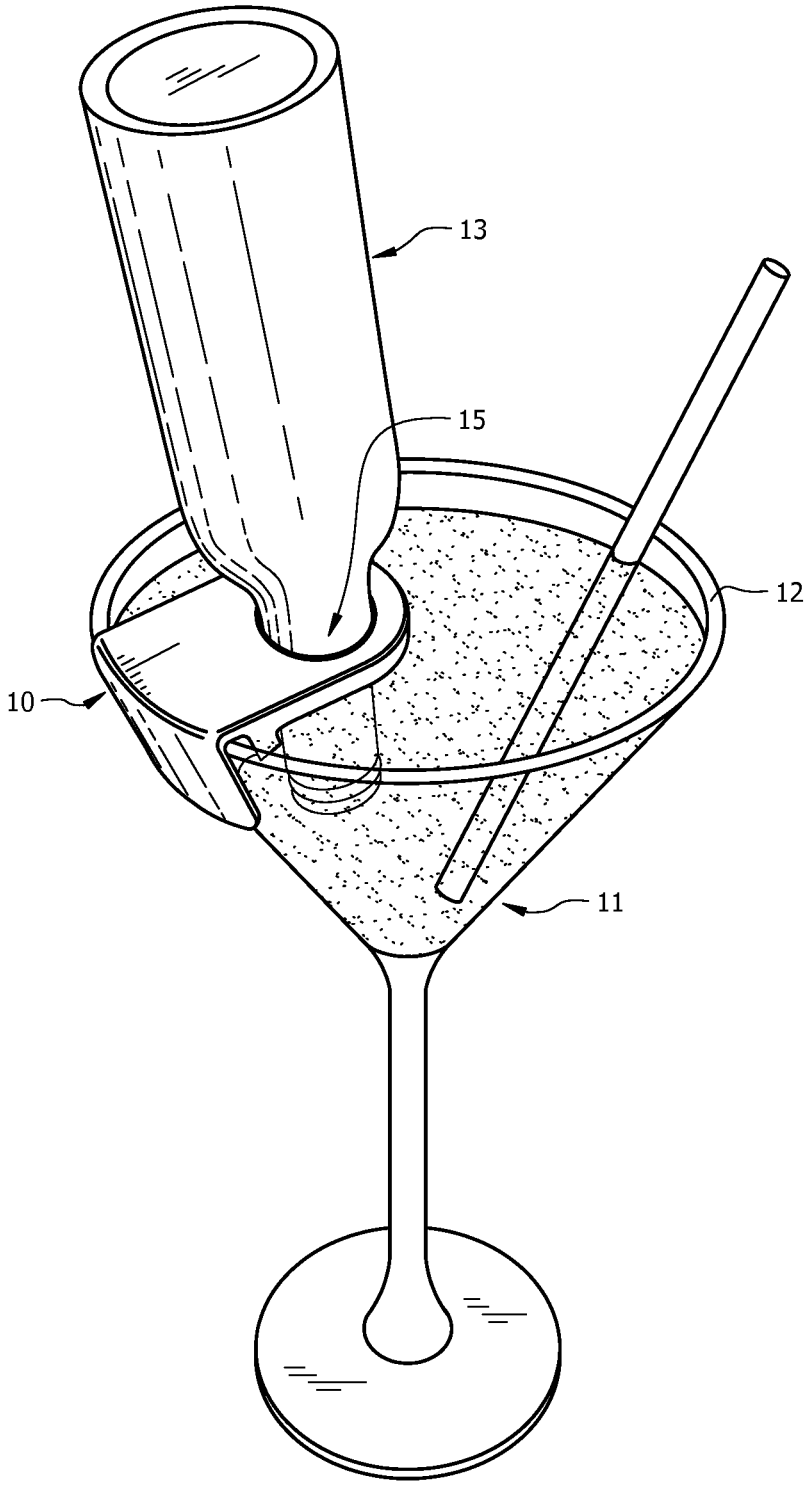
FIG. 1 is a perspective view of an embodiment of a bottle holder according to the concepts described herein holding a bottle inverted in a drinking glass.

Referring now to FIG. 1, an embodiment of a bottle holder according to the concepts described herein is shown. As described above, it has become popular to invert a bottle of beer into a frozen mixed drink to form a new type of cocktail. Most commonly a bottle of beer is inserted upside down into a frozen margarita to create a "beer rita." While this is the most popular example of such a drink, any types of beverages could be used, alcoholic or non-alcoholic. Typically, the bottle is set into the glass or pitcher and rests against the edge of the glass or pitcher. Unfortunately, a bottle in that position can be prone to falling or being knocked out of the glass or pitcher. The present invention describes a bottle holder that can be used to hold a bottle inverted in glass in a more stable manner.

Bottle holder 10 is an embodiment of a device to hold an inverted bottle in a glass or pitcher according to the concepts described herein. Bottle holder 10 is positioned on glass 11 by sliding it onto the rim 12, such that it is held securely on the glass. A bottle 13 can then be inserted upside down into an aperture sized to receive the neck 15 of the bottle in bottle holder 10 such that the bottle is held inverted in the glass 11.

Figure 2:
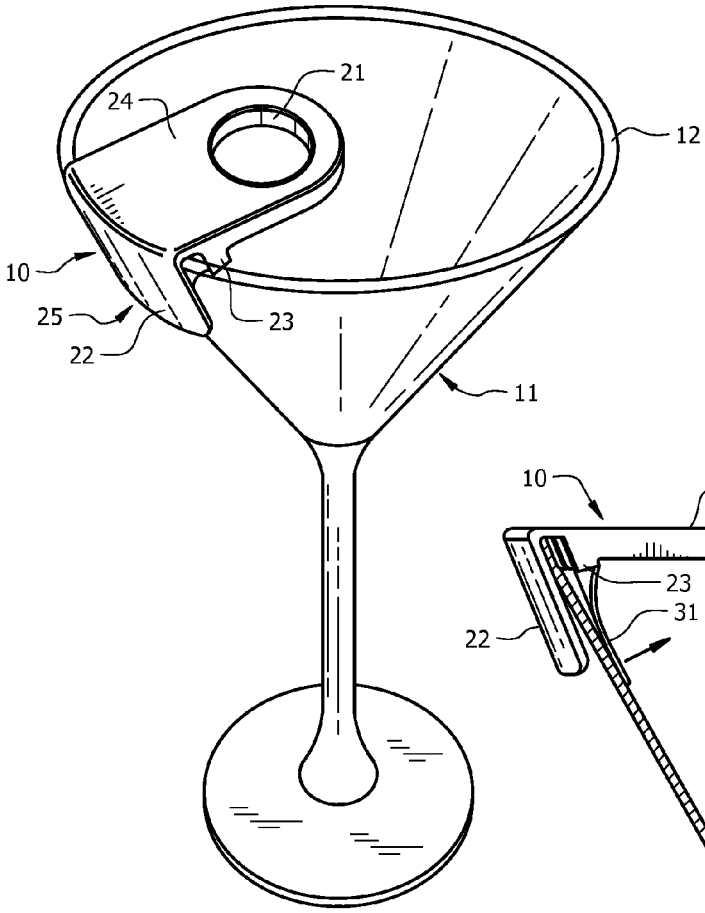
FIG. 2 is a perspective view of an embodiment of a bottle holder according to the concepts described herein on a drinking glass without the inverted bottle.
Figure 3:
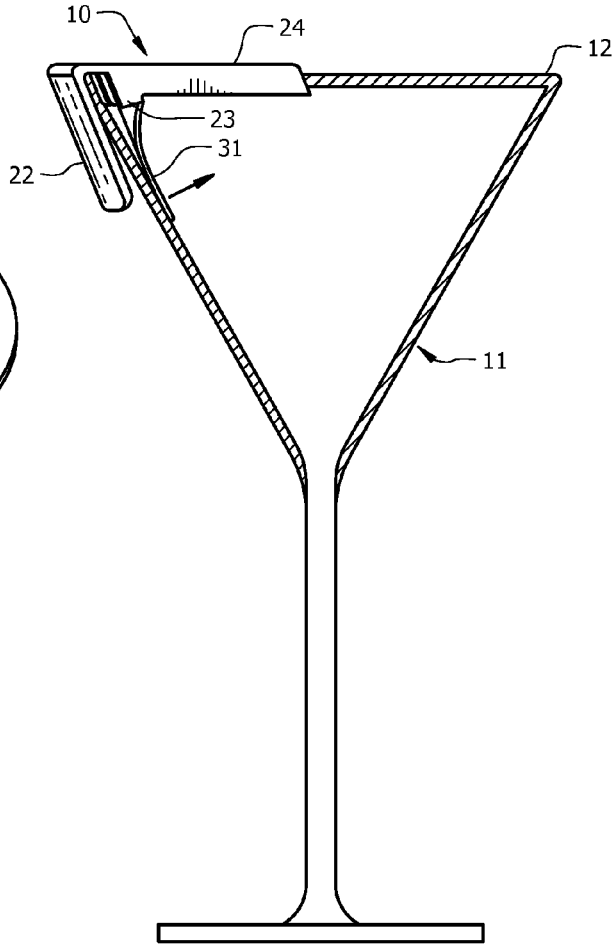
FIG. 3 is a side view of an embodiment of a bottle holder according to the concepts described herein shown on a cutaway of a drinking glass.
Figure 4:
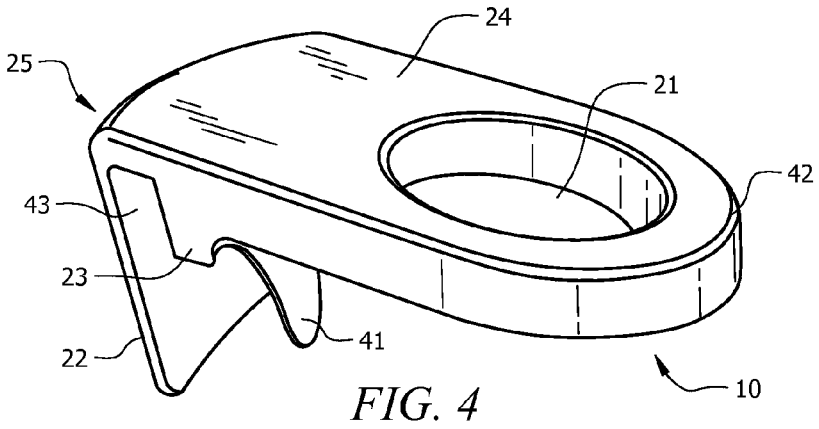
FIG. 4 is a perspective view of an embodiment of a bottle holder according to the concepts described herein.
Figure 5:
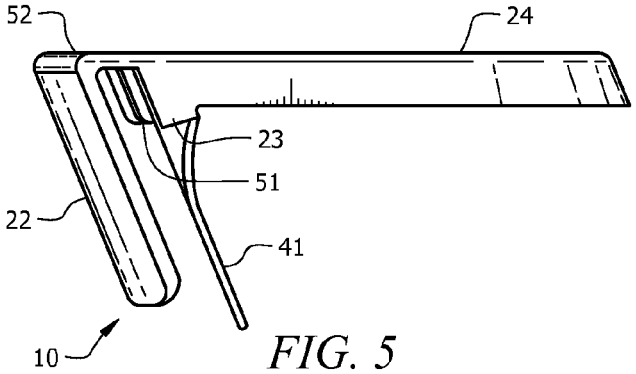
FIG. 5 is a side view of the embodiment of the bottle holder shown in FIG. 4.
Figure 6:
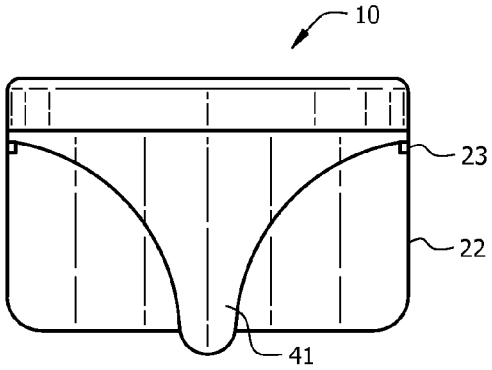
FIG. 6 is a front view of the embodiment of the bottle holder shown in FIG. 4.

Referring now to FIGS. 2-3, the embodiment of bottle holder 10 is described in more detail. Bottle holder 10 is formed by deck 24 and clip 22. Deck 24 is attached to, or formed integrally with, clip 22 and includes aperture 21. Aperture 21, shown in this embodiment as a circular cutout in deck 24, is sized to receive neck of a typical beer or soda bottle, but is smaller than the main diameter of the bottle such that the neck of the bottle will extend through aperture 21 but the remainder of the bottle will be held in place by the surface of deck 24 as the shoulders of the bottle, where the bottle transitions from the neck to the main portion, rest against the edges of the aperture and the upper surface of deck 24.

Clip 25 of bottle holder 10 includes outer wall 22 and inner wall 23. Bottle holder 10 is held in place on rim 12 of glass 11 by positioning the wall of the glass between outer wall 22 and inner wall 23. Outer wall 22 and inner wall 23 preferably are formed in a curve having the same diameter as the glass or pitcher so that bottle holder 10 fits easily over the glass. While an identical diameter is ideal, small variations between the glass diameter and the clip diameter can occur without substantially affecting the fit of bottle holder 10 on glass 11.

Referring now to FIGS. 4-8, a preferred embodiment of bottle holder 10 is described in greater detail. As described above, bottle holder 10 is formed by a deck 24, having an aperture 21 to accept the neck of a bottle, and clip 25. Edge 42 of deck 24 can be beveled to provide a pleasing appearance to bottle holder 10. Clip 25 includes outer wall 22 and inner wall 23 which hold the wall of a glass or pitcher between them when the bottle holder is in use. An upper wall 52 of clip 25, adjacent to deck 24, comes to rest on the rim of the glass when inserted. Though inner wall 23 can be of any suitable shape, in a preferred embodiment inner wall tapers into tongue 41. The taper in inner wall 23 allows for easier fit onto the rim of the glass. Also, in a preferred embodiment inner wall 23 is thinner than outer wall 22 and can be slightly flexible also to aid in proper placement.

Figure 7:
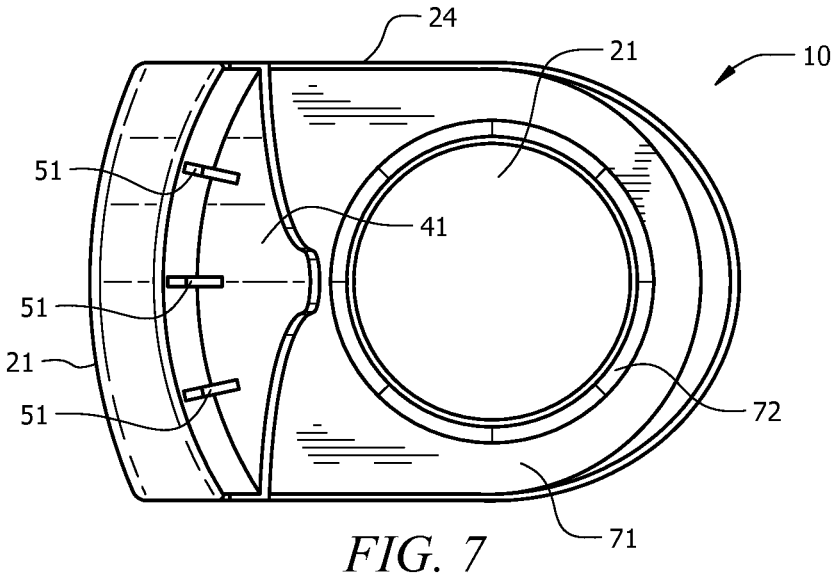
FIG. 7 is a bottom view of the embodiment of the bottle holder shown in FIG. 4.
Figure 8:
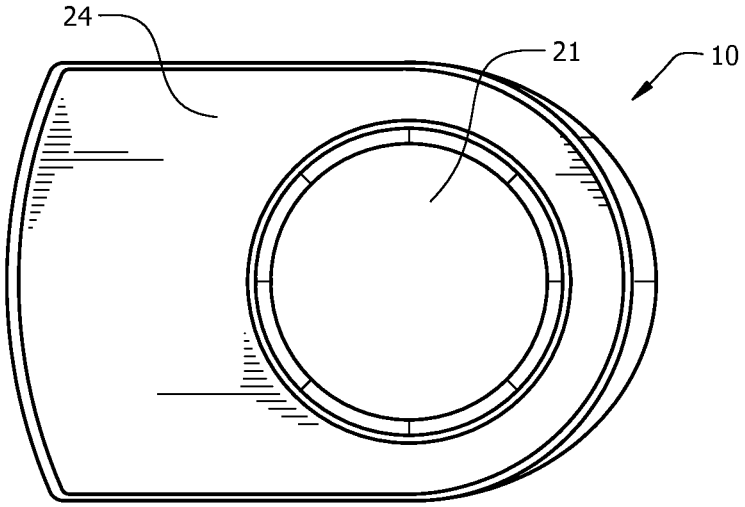
FIG. 8 is a top view of the embodiment of the bottle holder shown in FIG. 4.

Clip 25 is also preferably formed at an angle to deck 24, the angle corresponding to an angle of the glass, as shown in FIGS. 1-3. While a slightly acute angle is shown in FIGS. 4-8, clip 25 can be formed at any angle required by the glass or pitcher on which it is to be installed. Clip 25 also has a diameter, again to match the glass or pitcher onto which it is intended to be applied. In certain embodiments, support ridges 51 can be formed on the inner wall 23 providing additional structural support. As shown in FIG. 7, aperture 21 can be formed with a ring wall 72 extending below bottom surface 71 of deck 24. Ring wall 72 provides additional strength to deck 24 and additional support for the neck of a bottle inserted into aperture 21.

As an additional feature in certain embodiments of bottle holder 10, there is space on both deck 24 between aperture 21 and clip 25 for promotional or advertising material to be added to clip 10. Additional space for promotional or advertising material can be found on the exterior surface of outer wall 22 of clip 25. Clip 25 can be formed from any suitable material, but is preferably a plastic having enough strength to support a full bottle inserted into aperture 21 while bottle holder 10 is sitting on the rim of a glass or pitcher.

Figure 9:
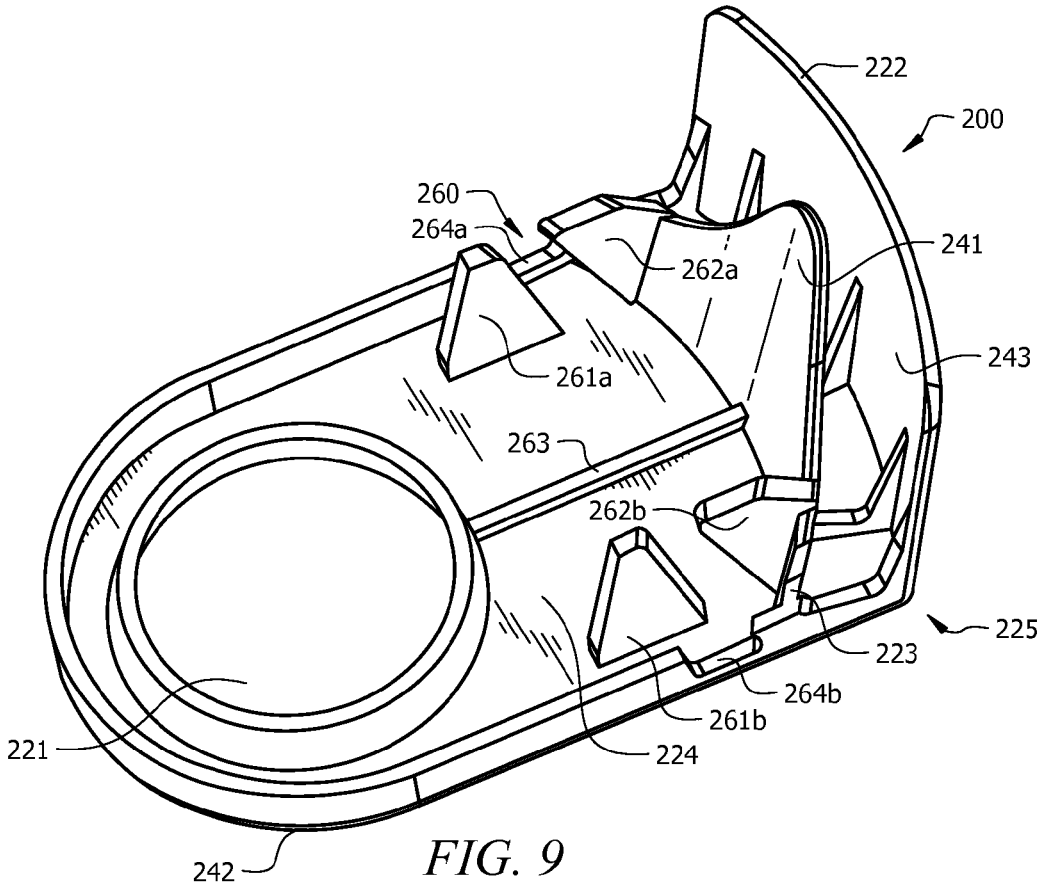
FIG. 9 is a bottom perspective view of an embodiment of a multi-glass bottle holder according to the concepts described herein.
Figure 10:
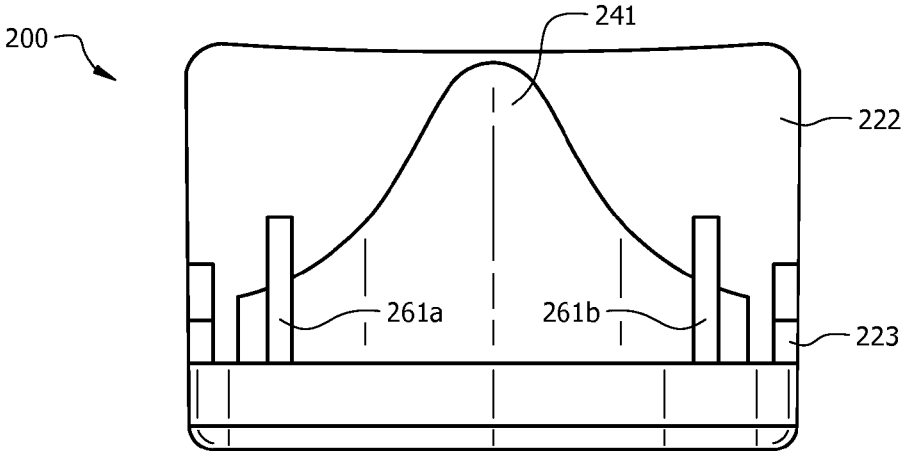
FIG. 10 is a front view of the embodiment of the multi-glass bottle holder shown in FIG. 9.
Figure 11:
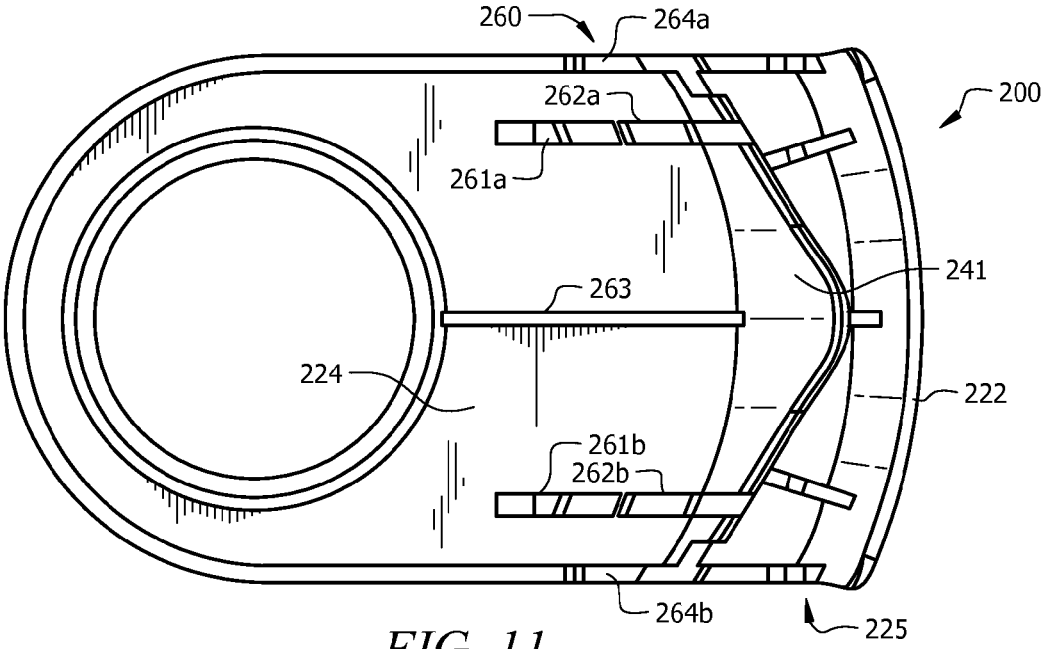
FIG. 11 is a bottom view of the embodiment of the multi-glass bottle holder shown in FIG. 9.
Figure 12:
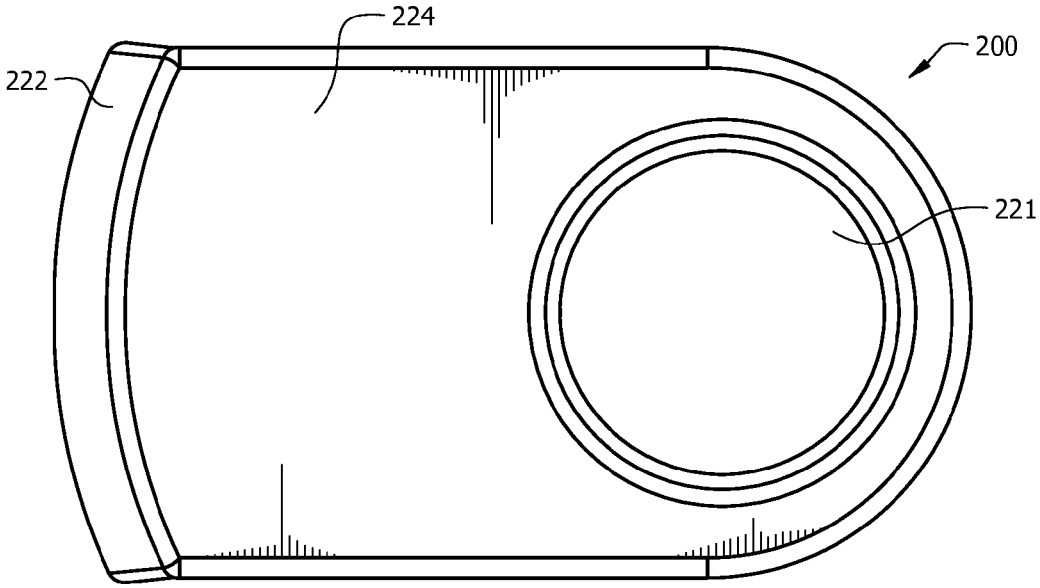
FIG. 12 is a top view of the embodiment of the multi-glass bottle holder shown in FIG. 9.
Figure 13:
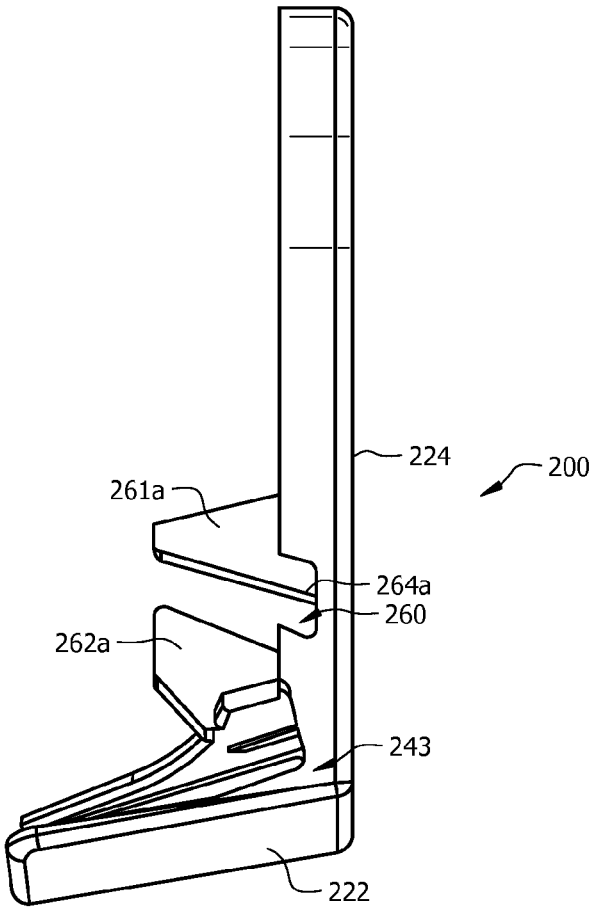
FIG. 13 is a side view of the embodiment of the multi-glass bottle holder shown in FIG. 9.
Figure 14:
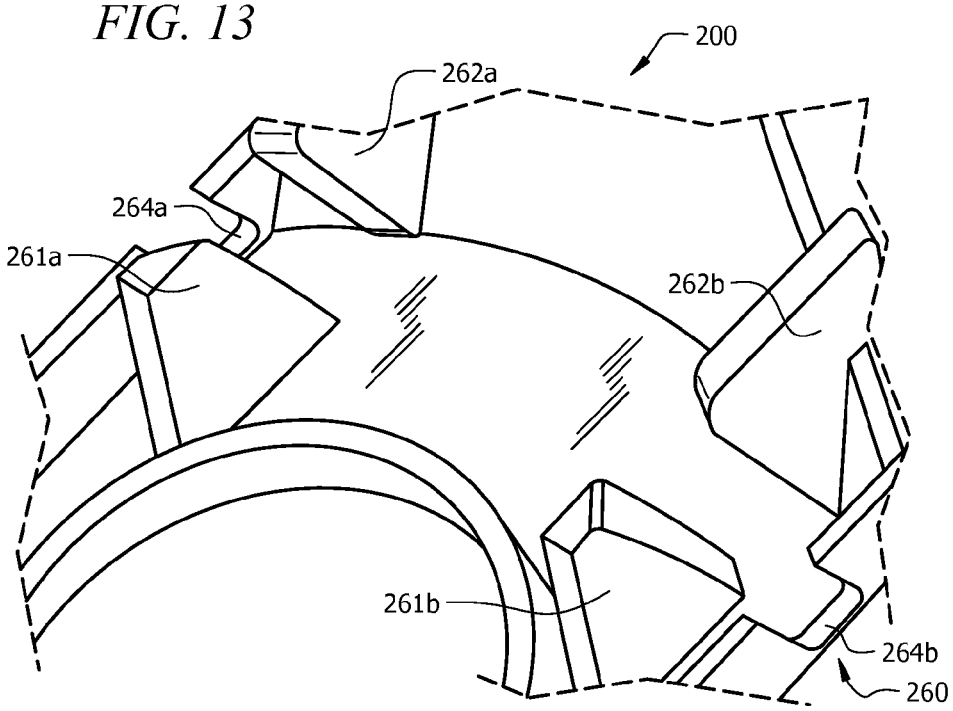
FIG. 14 is a detail view of the secondary glass attachment mechanism in the embodiment of the multi-glass bottle holder shown in FIG. 9.

Referring now to FIG. 9, an embodiment of a multi-glass bottle holder according to the concepts described herein is shown. As noted above, glasses come in a variety of shapes and configurations with the body of different glasses having different angles relative to the vertical orientation of the glass. The embodiment of the bottle holder shown in FIGS. 1-8 can be made to accommodate various orientations of glasses by making the holder with different angles for the clip mechanism. This requires different clips be used for a very angled glass, like a martini type glass, as opposed to a more vertical glass, like a goblet or mug. Multi-glass, or universal, bottle holder 200 can accommodate different glass orientations with a single device.

As with bottle holder 10 from FIG. 1, multi-glass bottle holder 200 is an embodiment of a device to hold an inverted bottle in a glass or pitcher according to the concepts described herein. Bottle holder 200 is positioned on glass by sliding it onto the rim, such that it is held securely on the glass. A bottle can then be inserted upside down into an aperture sized to receive the neck of the bottle in bottle holder such that the bottle is held inverted in the glass.

Bottle holder 200 is formed by deck 224 and outer clip 225 and inner clip 260. Deck 224 is attached to, or formed integrally with clips 225 and 260 and includes aperture 221. Aperture 221, shown in this embodiment as a circular cutout in deck 224, is sized to receive neck of a typical beer or soda bottle, but is smaller than the main diameter of the bottle such that the neck of the bottle will extend through aperture 221 but the remainder of the bottle will be held in place by the surface of deck 224 as the shoulders of the bottle, where the bottle transitions from the neck to the main portion, rest against the edges of the aperture and the upper surface of deck 224.

Outer clip 225 of bottle holder 200, which in this embodiment is oriented to fit glasses of a more vertical orientation, includes outer wall 222 and inner wall 223. Inner clip 260, which is oriented to fit glasses with a more angled orientation, includes inner braces 261*a* and 261*b* and outer braces 262*a* and 262*b*. Bottle holder 200 is held in place on the rim of a vertical glass by positioning the wall of the glass between inner surface 243 of outer wall 222 and inner wall 223, while for an angled glass the rim is positioned between inner braces 261*a*, 261*b* and outer braces 262*a*, 262*b*. Notches 264*a* and 264*b* also allow the rim of the glass to fit deeper into clip 200 providing additional support. Clips 225 and 260 are preferably formed in a curve having the same arc as the glass or pitcher so that multi-glass bottle holder 200 fits easily over the glass using either clip. While an identical diameter is ideal, variations between the glass diameter and the clip diameter can occur without substantially affecting the fit of bottle holder 200 on the glass.

Brace 263 is provided along the underside of deck 224 to provide additional rigidity to multi-glass bottle holder 200. Brace 263 may be included on the multi-glass bottle holder 200 embodiment as deck 224 is lengthened to accommodate clip 260. Edge 242 also provides additional rigidity and stability to deck 224. Inner wall 223 can be of any shape, but in preferred embodiments tapers to tongue 241.

Referring now to FIGS. 10-14, the preferred embodiment of bottle holder 20 is further described. As described above, bottle holder 200 is formed by a deck 224, having an aperture 221 to accept the neck of a bottle, and outer clip 225 and inner clip 260. Edge 242 of deck 224 can be beveled to provide a pleasing appearance to bottle holder 200. Outer clip 225 includes outer wall 222 and inner wall 223 which hold the wall of a glass or pitcher between them when the bottle holder is in use. Though inner wall 223 of outer clip 225 can be of any suitable shape, in a preferred embodiment inner wall tapers into tongue 241. The taper in inner wall 223 allows for easier fit onto the rim of the glass. Also, in a preferred embodiment inner wall 223 is thinner than outer wall 222 and can be slightly flexible also to aid in proper placement.

In a preferred embodiment outer clip 25 is designed to allow multi-glass bottle holder 200 to fit onto glasses with a more vertical wall and is therefore preferably formed at an angle close to or just less than 90 degrees to deck 24. While a slightly acute angle is shown, outer clip 225 can be formed at any angle required by the glass or pitcher on which it is to be installed. Inner clip 260 is designed to allow multi-glass bottle holder 200 to fit onto glasses with a more angled wall and is therefore formed at an acute angle relative to deck 224. Inner clip 260 is formed by inner braces 261*a*, 261*b* and inner braces 262*a*, 262*b*. Inner braces 261*b*, 261*b* protrude from the underside of deck 224 and are preferably equidistant from the centerline of bottle holder 200. Outer braces 262*a*, 262*b* protrude from inner wall 223, but could also be formed to extend from deck 224. Notches 264*a* and 264*b* in edge 242 allow the bottle holder 200 to fit further down onto the rim of the glass when using inner clip. As with outer clip 225, inner clip 260 can be formed at any desired angle to accommodate any type of glass or pitcher. Brace 263 provides additional support to deck 224.

In other respects multi-glass bottle holder 200 is designed and functions as described above with respect to bottle holder 10 in FIGS. 1-8.

As with bottle holder 10, as an additional feature in certain embodiments of universal bottle holder 200, there is space on both deck 224 between aperture 221 and clip 225 for promotional or advertising material to be added to clip 200. Additional space for promotional or advertising material can be found on the exterior surface of outer wall 222 of clip 225. Multi-glass bottle holder 200 can be formed from any suitable material, but is preferably a plastic having enough strength to support a full bottle inserted into aperture 221 while bottle holder 200 is sitting on the rim of a glass or pitcher.

Figure 15:
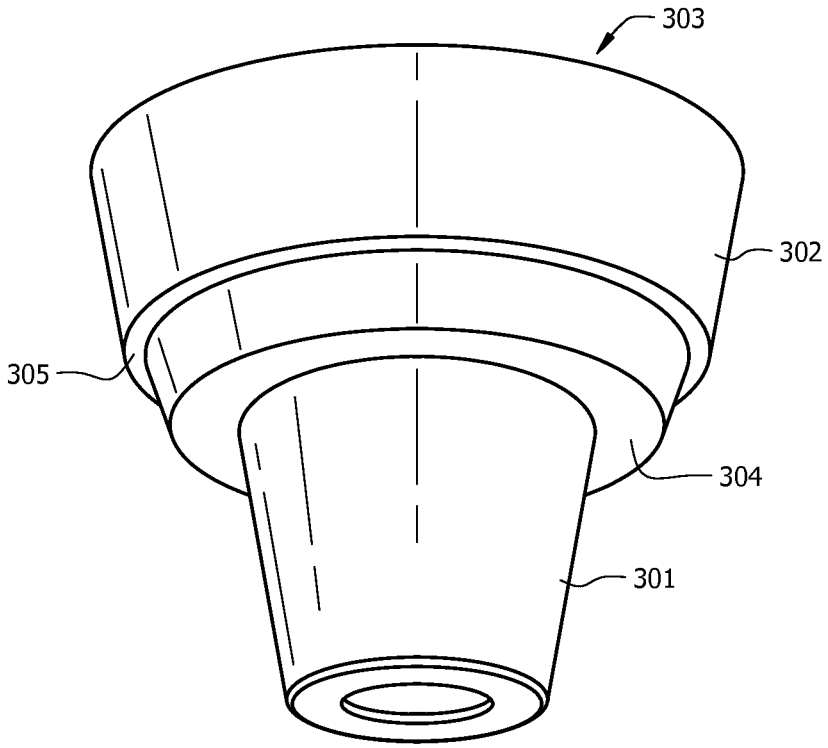
FIG. 15 is a bottom perspective view of an embodiment of an insert that can be inserted into the bottle holder of the present invention to allow the bottle holder to hold inverted cans.
Figure 16:
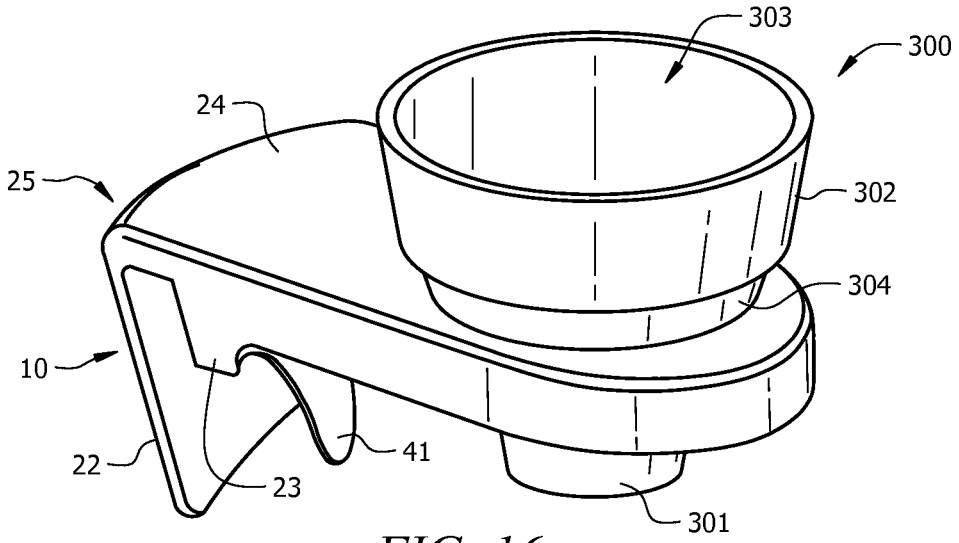
FIG. 16 is a top perspective view of the insert of FIG. 15 inserted into a bottle holder according to the concepts described herein.

Referring now to FIGS. 15 and 16, an embodiment of an insert for use with a bottle holder is shown. Insert 300 is formed by can receptacle 302 and insert neck 301. Insert neck 301 is sized to fit into the aperture of bottle holders 10 or 200 shown in FIGS. 1-14. Can receptacle 302 is sized to accept a can therein and to hold the can inverted so that it can drain into a glass or pitcher through the hole in neck insert 301. Ledge 305 is designed to hold the top of the can, thereby creating a space between ledge 305 and ledge 304 into which the contents of the can may drain. Ledge 304 provides the stop that rests against the deck 10 of bottle holder 10 when the bottle holder in mounted on a glass using clip 25.

Figure 17:
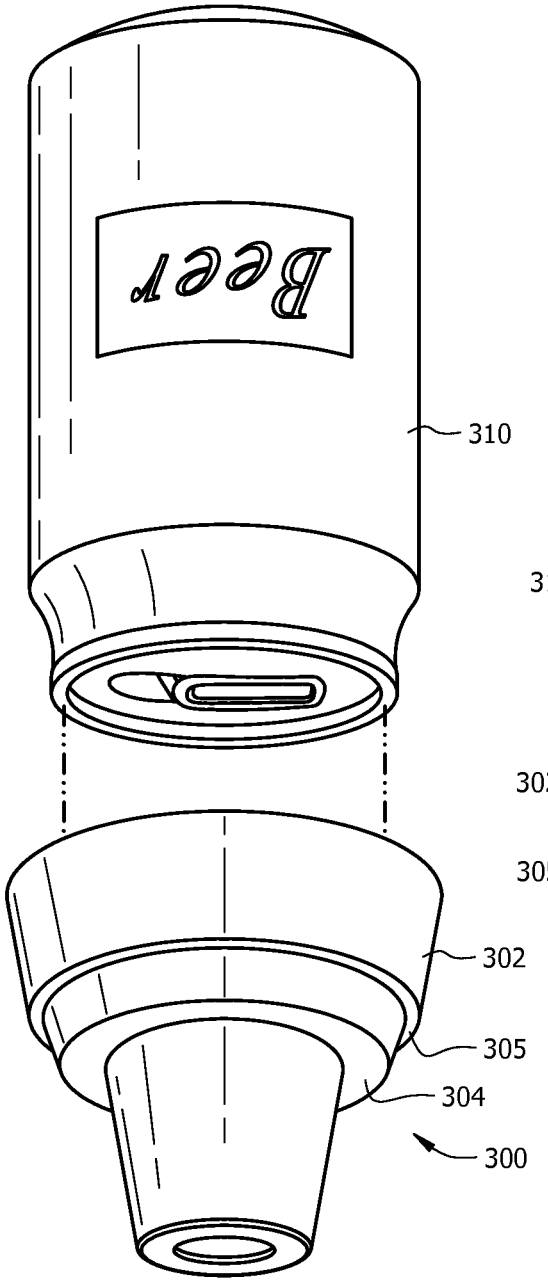
FIG. 17 is a perspective view of the insert of FIG. 15 with a can out of the insert.
Figure 18:
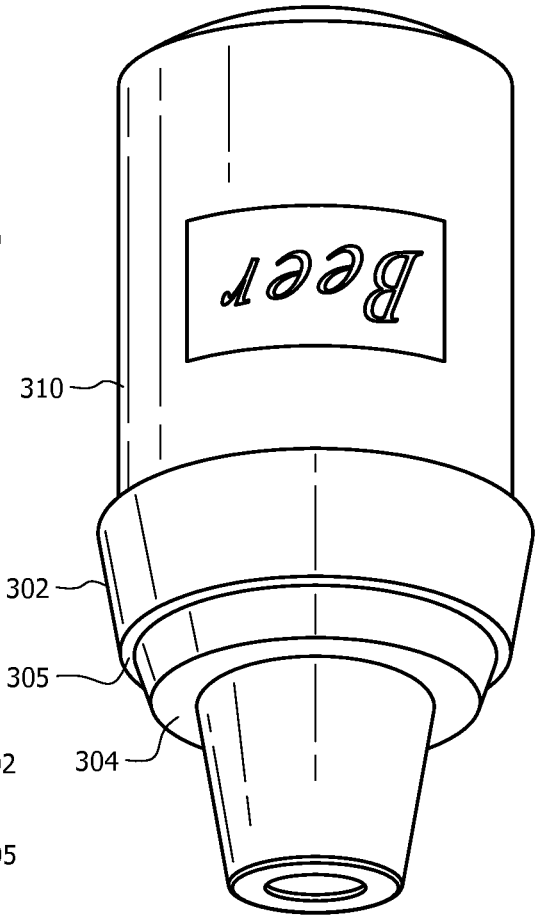
FIG. 18 is a perspective view of the insert of FIG. 15 with a can inserted therein.
Figure 19:
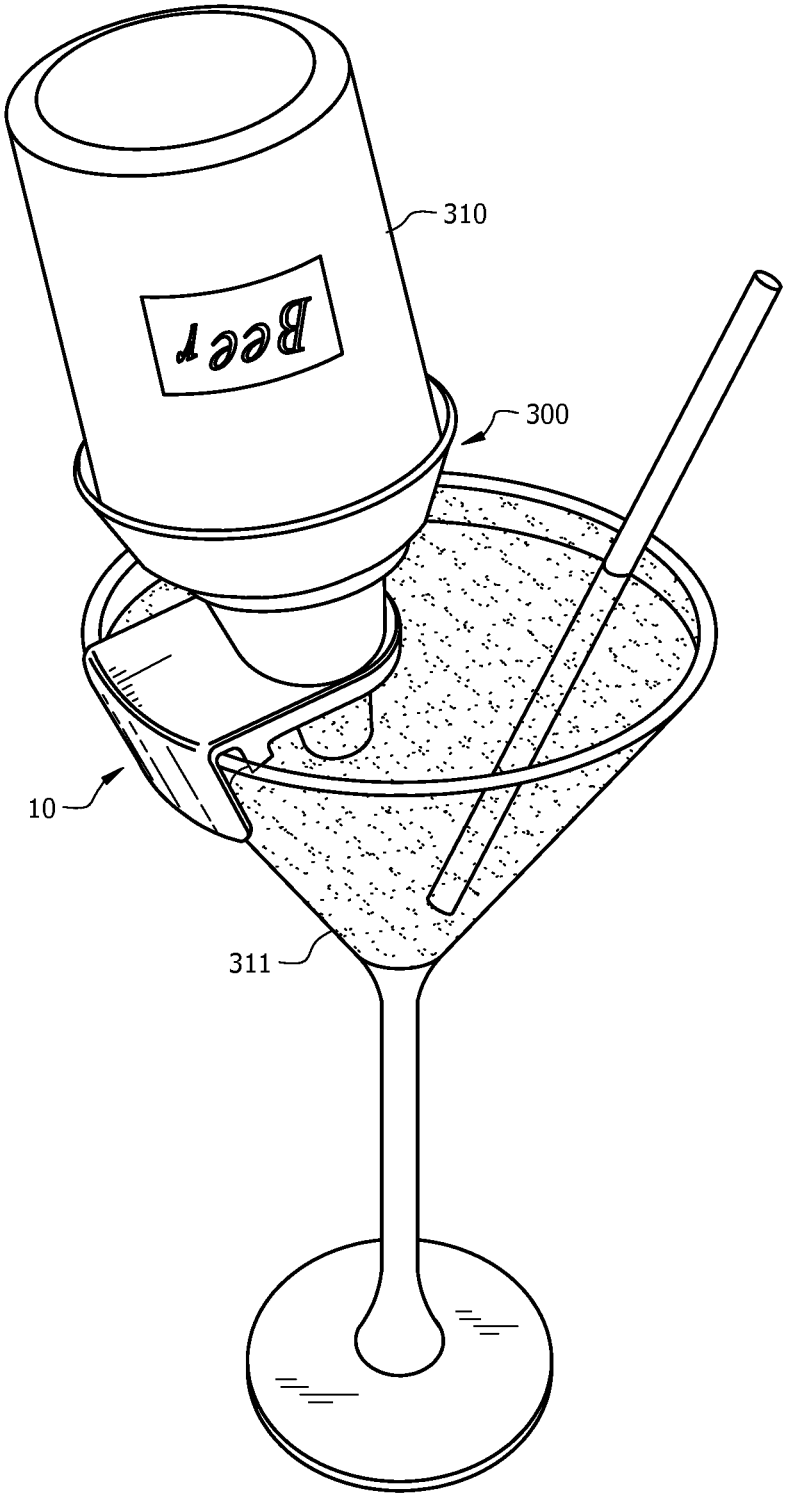
FIG. 19 is a perspective view of embodiments of a bottle holder and insert holding a can inverted in a glass.

FIGS. 17 and 18 show the insert of FIG. 15 in relation to a can before and after it is inserted into insert 300. Can 310 fits into can receptacle 302 and comes to a rest on ledge 305. FIG. 19 shows insert 300 being used with a clip 10 to hold a can 310 inverted in a glass 311.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A holder intended to hold a can upside down inside a container when attached thereto, the container having an exterior wall having an arc and oriented at an angle with respect to the vertical orientation of the container, the holder comprising:

a clip having an inner wall and an outer wall spaced to accept the exterior wall of the container in between, wherein the clip is formed at an arc corresponding to the arc of the exterior wall of the container;

a deck connected in a permanently fixed relationship to the clip and extending into the container, the deck including an aperture; and an insert inserted into the aperture in the holder, the insert formed by a can receptacle having a first ledge to hold the top of the can when inserted therein and a neck insert, the neck inserted into the aperture until a second ledge on the insert comes to rest against the deck of the holder.

2. The holder of claim 1 wherein the clip is at an angle to the deck, the angle corresponding, to the angle of the exterior wall of the container.

3. The holder of claim 1 wherein the clip is a universal clip comprising a first clip and a second clip, wherein the first clip is oriented to fit onto containers having a first range of angles of exterior walls, and wherein the second clip is oriented to fit onto containers having a second range of angles of exterior walls.

4. The holder of claim 1 wherein the aperture includes an inner ring wall.

5. The holder of claim 1 wherein the deck includes a space for displaying promotional material.

6. The holder of claim 1 wherein outer wall of the clip includes a space for displaying promotional material.

7. The holder of claim 1 wherein the can is a beer can.

8. The holder of claim 1 wherein the container the holder is intended to he attached to is a margarita glass.

9. The holder of claim 1 wherein the deck and the clip are integrally formed from molded plastic.

10. A method for holding a can inverted in an interior of a container, the container having an arc and an exterior wall oriented at an angle with respect to the vertical orientation of the container, the method comprising:

sliding a bottle holder onto the rim of the container the bottle holder comprising:

a clip having an inner wall and an outer wall spaced to accept the exterior wall of the container in between, wherein the clip is formed at an arc corresponding to the arc of the exterior wall of the container; and a deck connected in a permanently fixed relationship to the clip and extending into the container, the deck including an aperture;

inserting an insert into the aperture in the holder, the insert formed by a can receptacle having a first ledge to hold the top of the can when inserted therein and a neck insert, the neck inserted into the aperture until a second ledge on the insert comes to rest against the deck of the holder; and inserting a can inverted into aperture of the deck such that the bottle holder and insert holds the can inverted in the interior of the container.

11. The method of claim 10 further comprising displaying promotional material on the upper surface of the deck.

12. The method of claim 10 further comprising displaying promotional material on the outer surface of the outer wall of the clip.

13. The method of claim 10 wherein the clip is a universal clip comprising a first clip and a second clip, wherein the first clip is oriented to fit onto containers having a first range of angles of exterior walls, and wherein the second clip is oriented to fit onto containers having a second range of angles of exterior walls.

14. The method of claim 10 wherein the aperture includes an inner ring wall.

15. The method of claim 10 wherein the can is a beer can.

16. The method of claim 10 wherein the container is a margarita glass.

17. The method of claim 10 wherein the deck and the clip are integrally formed from molded plastic.

* * * * *